US008397952B2

(12) United States Patent
Kim et al.

(10) Patent No.: US 8,397,952 B2
(45) Date of Patent: Mar. 19, 2013

(54) REFRIGERATOR RELATED TECHNOLOGY

(75) Inventors: Seong-Jae Kim, Seoul (KR); Nam-Gi Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 638 days.

(21) Appl. No.: 12/607,126

(22) Filed: Oct. 28, 2009

(65) Prior Publication Data

US 2010/0252575 A1 Oct. 7, 2010

(30) Foreign Application Priority Data

Apr. 3, 2009 (KR) ..... 10-2009-0029113

(51) Int. Cl.
*B67D 7/00* (2010.01)

(52) U.S. Cl. ..... 222/146.1; 222/146.5; 62/389

(58) Field of Classification Search .... 222/146.1–146.6, 222/109, 110; 62/389
See application file for complete search history.

(56) References Cited

U.S. PATENT DOCUMENTS

| | | | | |
|---|---|---|---|---|
| 4,792,059 | A * | 12/1988 | Kerner et al. | 222/67 |
| 4,974,500 | A | 12/1990 | Boyd | |
| 6,179,168 | B1 * | 1/2001 | Desrosiers et al. | 222/185.1 |
| 6,207,046 | B1 | 3/2001 | Yamashita | |
| 6,871,675 | B1 * | 3/2005 | Marszalec et al. | 141/82 |
| 7,137,272 | B2 | 11/2006 | Park | |
| 7,748,570 | B2 * | 7/2010 | Bordino | 222/146.5 |
| 8,025,186 | B2 * | 9/2011 | Lee et al. | 222/146.6 |
| 2006/0144066 | A1 | 7/2006 | Lee | |
| 2007/0251261 | A1 | 11/2007 | Son et al. | |
| 2008/0226521 | A1 * | 9/2008 | Nakano et al. | 422/307 |
| 2009/0159611 | A1 * | 6/2009 | Roetker et al. | 222/1 |
| 2009/0266844 | A1 * | 10/2009 | McGuffey | 222/146.5 |

FOREIGN PATENT DOCUMENTS

| | | | |
|---|---|---|---|
| KR | 2005004927 | A | 1/2005 |
| KR | 2006106138 | A | 10/2006 |
| KR | 2007105809 | A | 10/2007 |

OTHER PUBLICATIONS

International Search Report & Written Opinion issued in Application No. PCT/KR2010/000819, mailed Jul. 30, 2010, 12 pages.

* cited by examiner

*Primary Examiner* — Kevin P Shaver
*Assistant Examiner* — Donnell Long
(74) *Attorney, Agent, or Firm* — Fish & Richardson P.C.

(57) ABSTRACT

A refrigerator includes a body having a cooling chamber and a door configured to open and close at least a portion of the cooling chamber. The refrigerator also includes a water source positioned at the cooling chamber or the door and configured to accommodate water. The refrigerator further includes a hot water supply unit positioned at the body or the door and configured to receive water from the water source, heat the water, and supply the heated water to outside of the body in response to a start signal. In addition, the refrigerator includes a hot water transferring unit that is connected to the hot water supply unit and configured to transfer the water remaining in the hot water supply unit after supplying the heated water to outside of the body is completed.

19 Claims, 9 Drawing Sheets

REFRIGERATOR RELATED TECHNOLOGY

RELATED APPLICATION

The present application claims the benefit of priority to Korean Application No. 10-2009-0029113, filed on Apr. 3, 2009, which is herein expressly incorporated by reference in its entirety.

FIELD

The present disclosure relates to refrigerator technology.

BACKGROUND

Generally, a refrigerator includes a body having a cooling chamber for storing items such as food or beverage, and a door for opening and closing the cooling chamber from outside. The body may have a refrigerating cycle for generating cold air.

The refrigerating cycle may be used a vapor compression type refrigerating cycle, which includes a compressor for compressing a refrigerant, a condenser for condensing the refrigerant, an expansion apparatus for expanding the refrigerant by a depressurizing process, and an evaporator for evaporating the refrigerant having absorbed the peripheral latent heat.

The refrigerator may have functions to enhance a user's satisfaction degree. For instance, the refrigerator may have an ice cube supply function for making ice cubes and providing the ice cubes to a user at the user's desired time. Furthermore, the refrigerator may have a cold water supply function for providing cold water to the user by cooling water supplied from outside by cold water through the cooling chamber.

SUMMARY

In one aspect, a refrigerator includes a body having a cooling chamber. The refrigerator also includes a door configured to open and close at least a portion of the cooling chamber. The refrigerator further includes a water source positioned in the body and configured to accommodate water. In addition, the refrigerator further includes a hot water supply unit positioned at the body or to the door and configured to receive water from the water source, heat the water, and supply the heated water to outside of the body in response to a hot water dispensing start signal. The refrigerator further includes a hot water transferring unit that is connected to the hot water supply unit and configured to transfer the water remaining in the hot water supply unit after supplying the heated water to outside of the body is completed.

Implementations may include one or more of the following features. For example, the hot water supply unit includes a hot water storage portion configured to store water supplied from the water source. The hot water supply unit also includes a heating portion configured to heat the water stored in the hot water storage portion. The hot water storage portion is a hermetic container. The heating member is a heat wire configured to generate heat by an electric resistance. The water source is a water storage tank configured to store water supplied from outside, and the water storage tank and the hot water supply unit are connected to each other. The water storage tank is installed inside the cooling chamber or on a rear surface of the door.

In some examples, the hot water transferring unit includes a water pipe connected to the water source and configured to transfer the water remaining in the hot water supply unit to the water source. The water pipe has a plurality of heat emitting fins on an outer circumferential surface. The water remaining in the hot water supply unit is transferred in response to detecting a hot water dispensing end signal that indicates supplying the heated water to outside of the body is completed. The hot water transferring unit is connected to the water source and configured to transfer the water remaining in the hot water supply unit to the water source for recollection.

In some implementations, an amount of the water supplied to the hot water supply unit is adjusted by controlling an operation time. The refrigerator further includes a switching unit configured to generate the hot water dispensing start signal. The switching unit is configured to be turned on/off by using an electronic button. The refrigerator further includes a display unit configured to display a predicted time or period when hot water is supplied to a user. An alarm sound is generated during displaying the predicted time or period.

In another aspect, a refrigerator includes a body having a cooling chamber. The refrigerator also includes a door configured to open and close at least a portion of the cooling chamber. The refrigerator further includes a water source positioned outside of the body configured to accommodate water. In addition, the refrigerator includes a hot water supply dispenser. The hot water supply dispenser includes a hot water supply unit positioned at the body or the door and configured to heat water supplied from the water source and supply the heated water to outside of the body in response to a hot water dispensing start signal. The hot water supply dispenser also includes a hot water transferring unit connected to the hot water supply unit and configured to transfer the water remaining in the hot water supply unit after supplying the heated water to outside of the body is completed.

Implementations may include one or more of the following features. For example, the water source is a water tank configured to store water at a room temperature, and the water tank and the hot water supply unit are connected to each other. The hot water transferring unit is connected to the water source and configured to transfer the water remaining in the hot water supply unit to the water source for recollection. The refrigerator further includes a display unit configured to display a predicted time or period when hot water is supplied to a user.

In yet another aspect, a refrigerator includes a body having a cooling chamber. The refrigerator also includes a door configured to open and close at least a portion of the cooling chamber. The refrigerator further includes a water source positioned within the body and configured to accommodate water. In addition, the refrigerator includes a hot water supply dispenser. The hot water supply dispenser includes a hot water storage portion configured to store water supplied from the water source. The hot water supply dispenser also includes a heating portion configured to heat the water stored in the hot water storage portion, wherein the water stored in the hot water storage portion is heated by the heating portion for a predetermined time or period, the heated water in the hot water storage portion is supplied to outside of the body and the remaining hot water in the hot water storage portion is disposed from the hot water storage portion after supplying the heated water to outside of the body is completed.

Implementations may include one or more of the following features. For example, the water source is a water storage tank configured to store water supplied from outside, and the water storage tank and the hot water supply unit are connected to each other. The water remaining in the hot water storage portion is disposed from the water storage portion in response to detecting a hot water dispensing end signal. The refrigerator further includes a display unit configured to display a predicted time or period when hot water is supplied to a user.

In yet another aspect, a method of supplying hot water in a refrigerator includes storing water in a water source positioned in a body of the refrigerator or attached to the body of the refrigerator. The method also includes heating water stored in a hot water supplying unit provided from the water source for a predetermined time or period in response to a start signal. The method further includes supplying an amount of hot water to a user when the heating is finished. In addition, the method includes transferring the water remaining in the hot water supply unit to the water source when the supplying the heated water to the user is completed.

Implementations may include one or more of the following features. For example, displaying a time or period indicating when a hot water is served to the user. Stopping the heating the water after the hot water is supplied to the user.

In yet another aspect, a method of supplying hot water in a refrigerator includes storing water in a water source positioned in a body of the refrigerator. The method also includes heating the water stored in a hot water storage portion provided from the water source for a predetermined time or period in response to a start signal. The method further includes supplying an amount of hot water to a user when the heating time or period is finished. In addition, the method includes disposing hot water remaining in the water storage portion after the supplying the heated water to the user is completed.

Implementations may include one or more of the following features. For example, displaying a time or period indicating when a hot water is served to the user.

DETAILED DESCRIPTION

Figure 1:
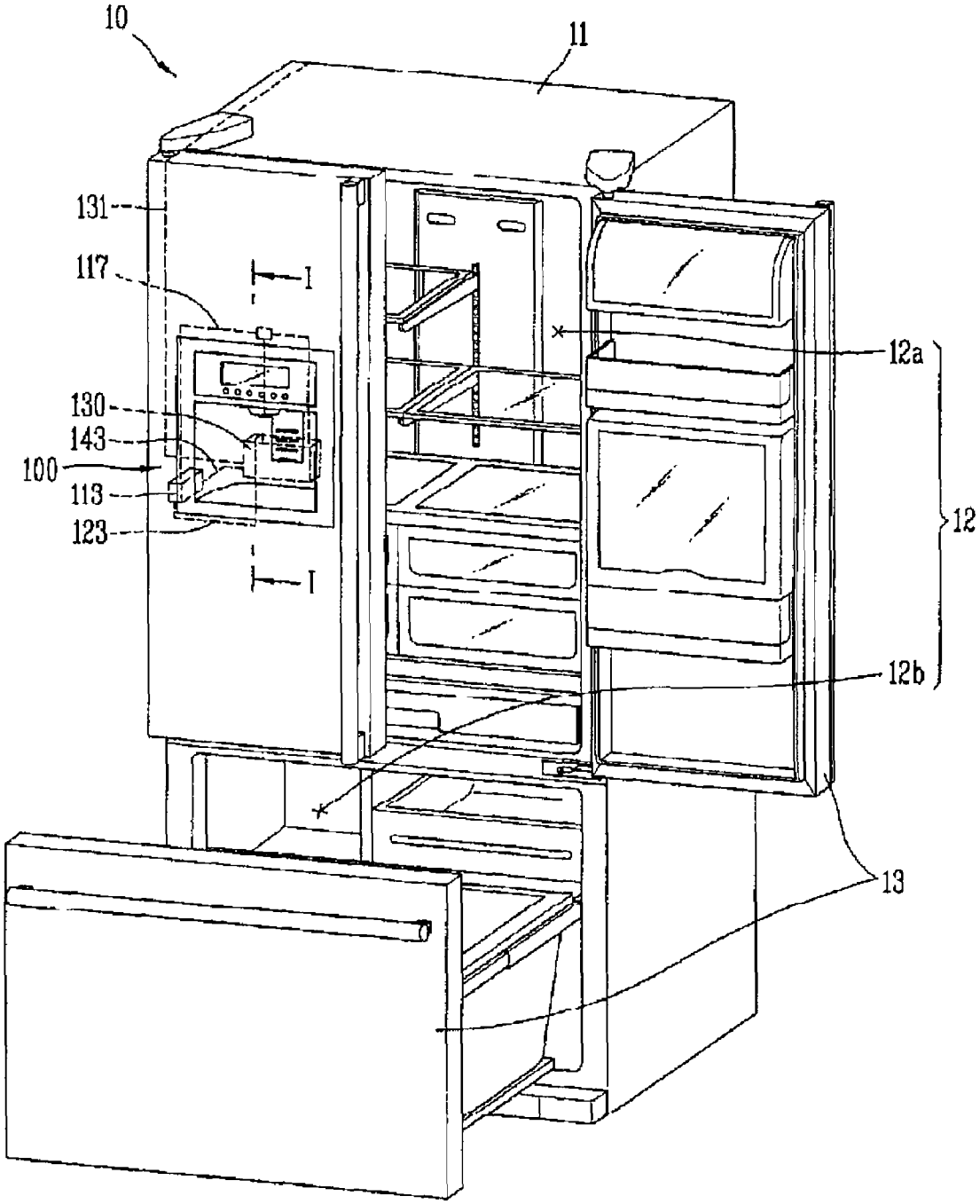
FIG. 1 is a perspective view of a refrigerator having a device for dispensing hot water.

Referring to FIG. 1, a refrigerator 10 includes a body 11 having at least one cooling chamber 12 for storing food items at a low temperature, and at least one door 13 for opening and closing the cooling chamber 12 from outside. The body 11 may have a refrigerating cycle for providing cold air to the cooling chamber 12. A vapor compression type refrigerating cycle for generating cold air may be used. In the vapor compression type refrigerating cycle, a refrigerant repeatedly undergoes compression, condensation, expansion, and evaporation processes.

A mechanism for cooling the cooling chamber 12 by the refrigerating cycle may include an indirect cooling method for cooling the cooling chamber 12 by supplying cold air generated by being heat-exchanged with the refrigerating cycle, to the cooling chamber 12; and a direct cooling method for directly cooling the cooling chamber 12 by directly heat-exchanging an inside of the cooling chamber 12 with the refrigerating cycle.

The cooling chamber 12 may be divided into a refrigerating chamber 12*a* and a freezing chamber 12*b* according to storage temperatures of food items. And, the doors 13 are disposed at the refrigerating chamber 12*a* and the freezing chamber 12*b*, respectively.

The door 13 serves to open and close openings of the refrigerating chamber 12*a* and the freezing chamber 12*b* so as to store or get food items into or from the refrigerating chamber 12*a* and the freezing chamber 12*b*. Accordingly, the refrigerating chamber 12*a* and the freezing chamber 12*b* are opened and closed from outside.

As shown in FIG. 1, in order to open and close the refrigerating chamber 12*a* and the freezing chamber 12*b*, the door 13 may be hinge-coupled to one side of the body 11 so as to be rotatable centering around a height direction of the body 11.

Alternatively, the door 13 may be configured to slide in back and forth directions of the body 11, and to open and close the refrigerating chamber 12*a* or the freezing chamber 12*b*.

The refrigerator 10 of FIG. 1 is referred as a 'bottom freezer type' refrigerator where the refrigerating chamber 12*a* is disposed at an upper side and the freezing chamber 12*b* is disposed at a lower side.

The bottom freezer type refrigerator is a mere example for convenience. Accordingly, the positions of the refrigerating chamber 12*a*, the freezing chamber 12*b*, and the type of the door 13 may be using different types and configurations.

Figure 2:
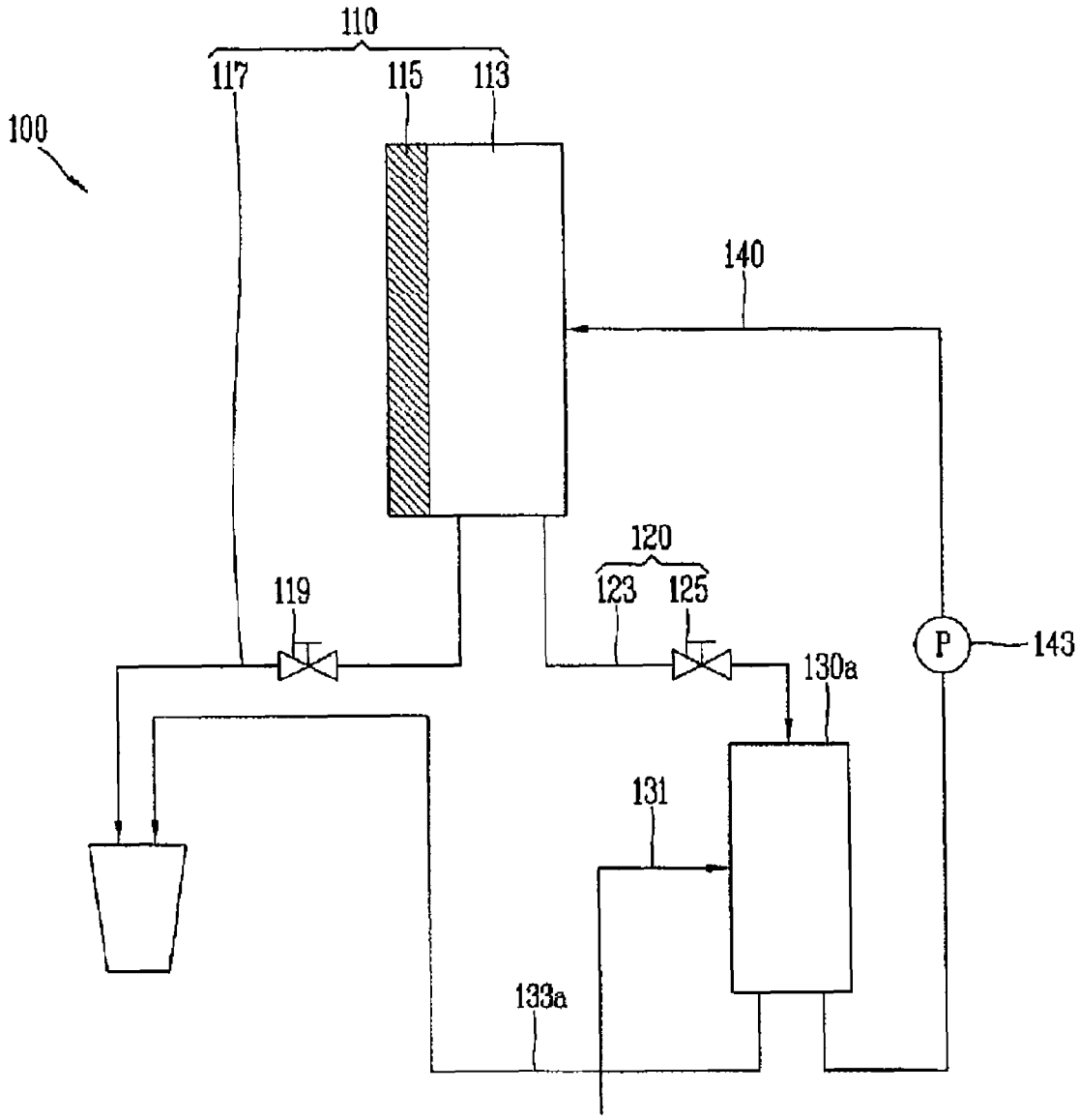
FIG. 2 is a water pipe diagram of the device for dispensing hot water of FIG. 1.

The refrigerator 10 has a device for dispensing hot water 100 for supplying hot water to outside of the body 11. Referring to FIGS. 1 and 2, the device for dispensing hot water 100 includes a hot water supply unit 110 for storing water supplied from a water source 130, heating, and supplying the heated water to outside of the body 11; and a hot water recollection unit 120 for recollecting the water remaining in the hot water supply unit 110 to the water source 130.

The device for dispensing hot water 100 may be installed inside the door 13, or on a rear surface of the door 13, e.g., the surface of the door 13 facing the cooling chamber 12 when the door 13 is closed. The water source 130 may be implemented as a water supply source 130*a* or a purifying device separately disposed from the body 11 and receiving water from a wellspring.

Once water is supplied from the wellspring, the water passes through a hinge-coupling groove positioned on an upper surface of the door 13 for hinge coupling, via rear and upper surfaces of the body 11, thereby being provided into the door 13. For providing the water, a tube 131 may be used.

The water provided into the door 13 is supplied to the water source 130 of the door 13, and is stored therein. And, the water stored in the water source 130 is supplied to the hot water supply unit 110 to be heated. After the water is heated to a predetermined temperature, the water may be discharged out of the body 11 (may be supplied to a user).

The hot water remaining in the hot water supply unit 110 after discharging the hot water, is recollected to the water source 130.

A tube or a water pipe may be applied to the hot water supply unit 110 for water supply and water recollection.

The hot water supply unit 110 may include a hot water storage portion 113 for storing water supplied from the water source 130; a heating portion 115 for heating the water stored in the hot water storage portion 113; and a hot water discharge pipe 117 for providing the water heated by the heating portion to a user.

The water source 130 is connected to the hot water storage portion 113 by a water supply pipe 140 for water supply. The water supply pipe 140 may be further provided with a pump 143 for controlling the amount of water supplied to the hot water storage portion 113. The amount of water supplied to the hot water storage portion 113 may be adjusted by controlling an operation time of the pump 143. By a hot water dispensing start signal, water supply to the hot water storage portion 113, heating of the water by the heating portion 115, and discharging of the hot water through the hot water discharge pipe 117 are sequentially performed.

The hot water recollection unit 120 may include a water recollection pipe 123 for connecting the hot water supply unit 110 and the water source 130 to each other, and a hot water recollection valve 125 for controlling a recollection operation of hot water by opening and closing the water recollection pipe 123. The hot water recollection valve 125 is opened by a hot water discharge completion signal after completion of hot water supply to user and is closed by a hot water recollection completion signal or dispensing start signal. The hot water discharge pipe 117 may have a hot water discharge valve 119 for controlling discharge of hot water by opening and closing the hot water discharge pipe 117.

Accordingly, because hot water is not stored in the hot water storage portion 113 for a long time by discharging out or eliminating remaining hot water stored in the hot water storage portion 113 as soon as the hot water is supplied to the user, bacteria or microbes in the hot water storage portion 113 may be reduced. This may allow sanitary hot water to be provided to the user.

Furthermore, the water source 130 may be configured to cool water stored therein. That is, the water source 130 may be implemented as a cold water storage tank 130*a* for cooling water stored in the water source 130 by cold water of supplied from the cooling chamber 12. And, the cold water storage tank 130*a* may have a cold water supply pipe 133*a* for supplying cold water to outside of the body 11.

Figure 3:
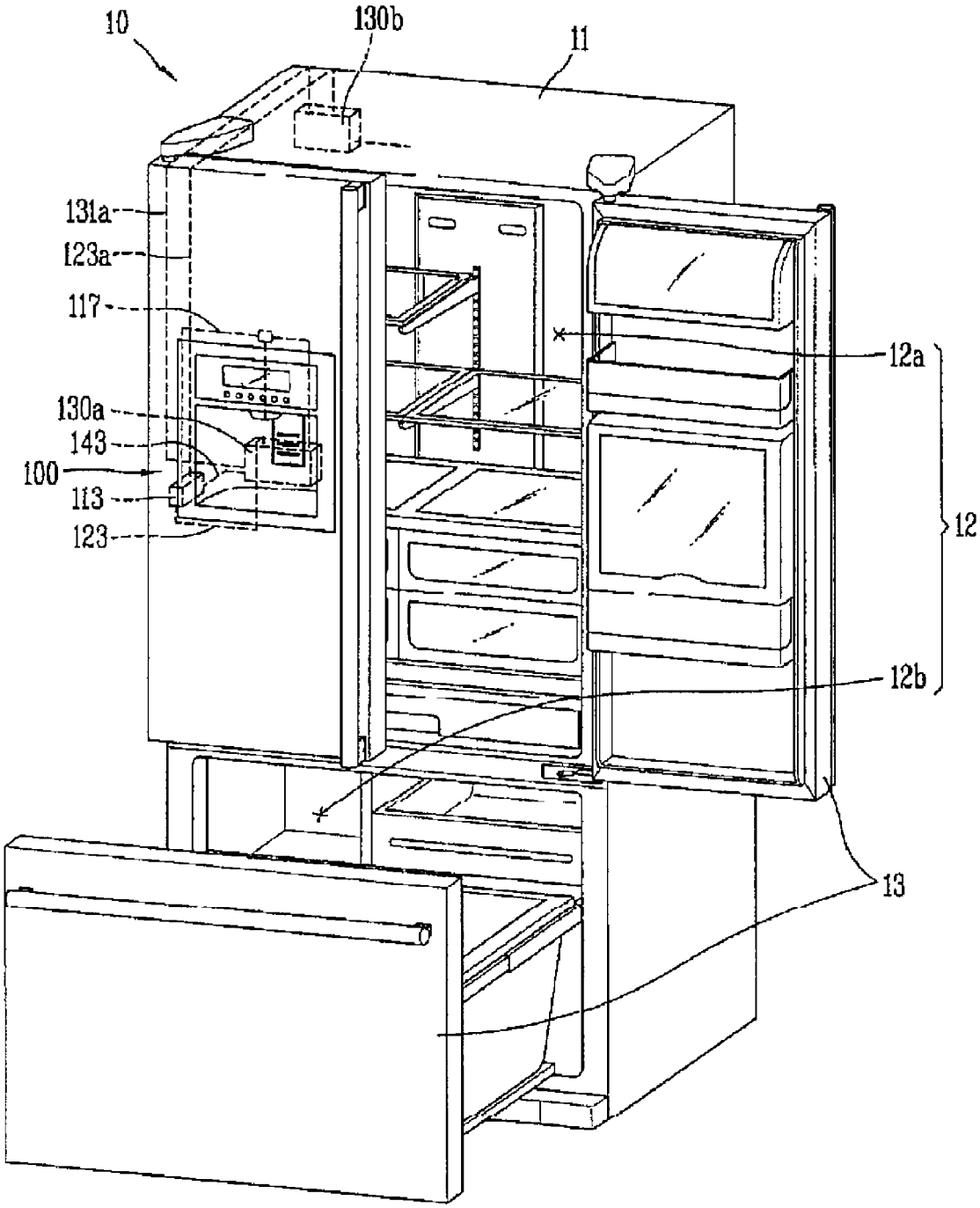
FIG. 3 is a perspective view of a refrigerator having an example of the device for dispensing hot water of FIG. 1.

As shown in FIG. 3, the cold water storage tank 130*a* may be disposed on a rear surface of the door 13 adjacent to the cooling chamber 12, for an efficient cooling of the water stored therein. Alternatively, the cold water storage tank 130*a* may be installed at the cooling chamber 12, more concretely, inside the refrigerating chamber 12*a*. In the case of cooling the cold water storage tank 130*a* by using cold air of the freezing chamber 12*b*, a cooling time may be shortened.

Referring to FIG. 3, the water source 130 may be implemented as a water storage tank 130*b* separately disposed from the hot water storage portion 113 and the cold water storage tank 130*a*.

The water storage tank 130*b* is provided on a rear surface of the body 11, thereby storing water supplied from the wellspring.

The water storage tank 130*b* is connected to the cold water storage tank 130*a* by a tube 131*a*, etc. And, the water storage tank 130*b* is connected to the hot water storage portion 113 by a water recollection pipe 123*a* so as to recollect hot water after hot water has been supplied to outside.

As the hot water storage portion 113 and the cold water storage tank 130*a* are connected, water stored in the cold water storage tank can be supplied to the hot water storage portion 113.

Alternatively, water stored in the water storage tank 130*b* and the cold water storage tank 130*a* may be supplied to the hot water storage portion 113 by diverging the tube that connects the water storage tank 130*b* and the cold water storage tank 130*a* to each other.

In this implementation, after hot water stored in the hot water supply unit 110 has been discharged to outside, the hot water remaining in the hot water supply unit 110 is recollected to the water storage tank 130*b* located in outside of the refrigerator having a room temperature, not to the cold water storage tank 130*a*. This may solve a problem that the temperature-increased cold water may be provided to the user. Furthermore, in the case of supplying the water stored in the water storage tank 130*b* having a room temperature is supplied to the hot water storage portion 113, a heat amount required to heat the water stored in the hot water storage portion 113 may be reduced.

Figure 4:
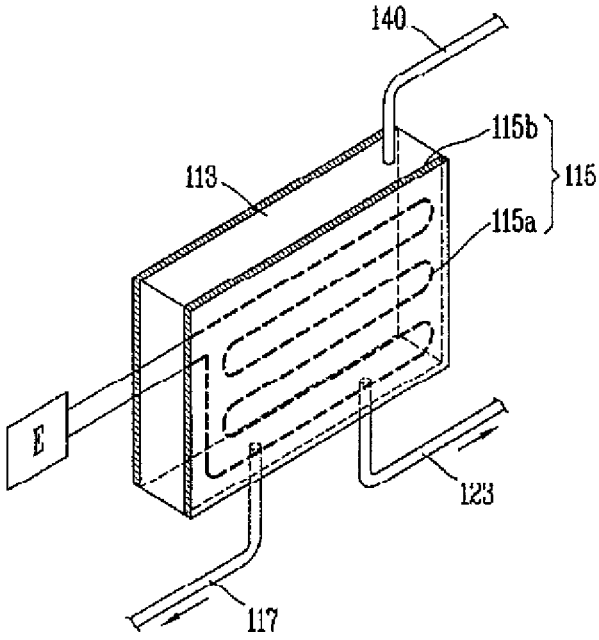
FIG. 4 is a disassembled perspective view of a hot water supply unit of FIG. 1.

Referring to FIG. 4, the hot water supply unit 110 includes a hot water storage portion 113, a heating portion 115, and a hot water discharge pipe 117. The hot water storage portion 113 may be implemented as a hermetic container for storing water. And, the hot water storage portion 113 may have the hot water discharge pipe 117, a water supply pipe 140 for receiving water from the water source 130, and a water recollection pipe 123 for recollecting hot water to the water source 130. The water source 130 is implemented as the cold water tank 130*a*, the water tank 130*b* or the cold water tank 130*a* and the water tank 130*b*

The heating portion 115 may include a heating member 115*a* installed on an outer surface of the hot water storage portion 113, and a heat transfer member 115*b* for fixing the heating member 115*a* to the hot water storage portion 113, and transferring heat generated from the heating member 115*a* to the hot water storage portion 113. The heating member 115*a* may be implemented as a heat wire for generating heat by an electric resistance. The heat transfer member 115*b* may be defined as a material having high conductivity such as copper or aluminum.

Figure 5:
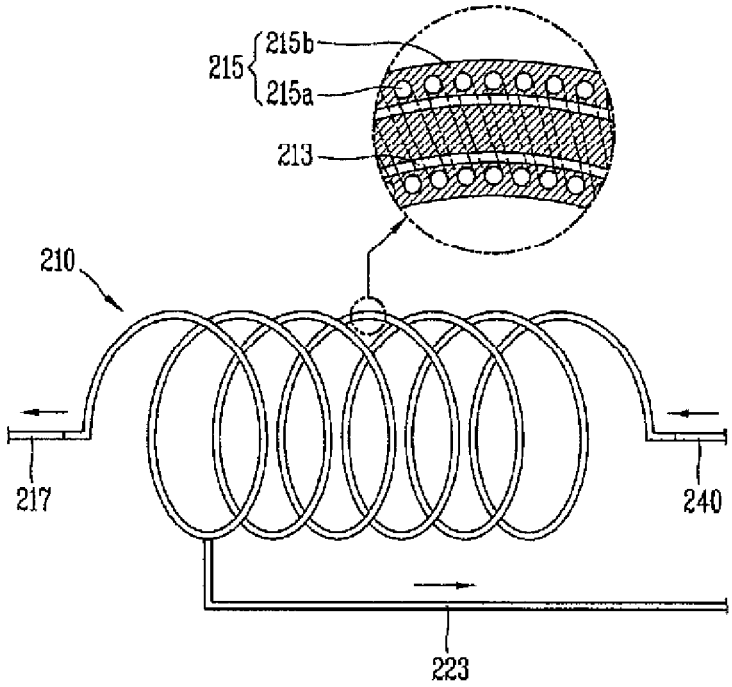
FIG. 5 is an example of a hot water storage portion of FIG. 4.

Referring to FIG. 5, a hot water supply unit 210 may include a hot water storage portion 213 defined as a tube curved a plurality of times, and a heating portion 215 for heating the hot water storage portion 213. The hot water storage portion 213 is curved a plurality of times in the form of a coil. One end of the hot water storage portion 213 is connected to a water supply pipe 240 that is connected to the water source 130, and another end thereof is connected to a hot water discharge pipe 217.

The heating portion 215 may include a heating member 215*a* for covering an outer surface of the tube, and a heat transfer member 215*b* for fixing the heating member 215*a* to an outer surface of the tube. The heating member 215*a* may be implemented as a heat wire for generating heat by an electric resistance. One side of the hot water storage portion 213 may have a water recollection pipe 223 for recollecting hot water. For instance, one end of the water recollection pipe 223 is connected to an end portion of the hot water storage portion 213, while another end of the water recollection pipe 223 is connected to the water source 130. As the hot water storage portion 213 is implemented as a tube curved a plurality of times, a heat transfer area contacting the heating member 215*a* may increase. This may allow hot water to be more rapidly dispensed.

Figure 6:
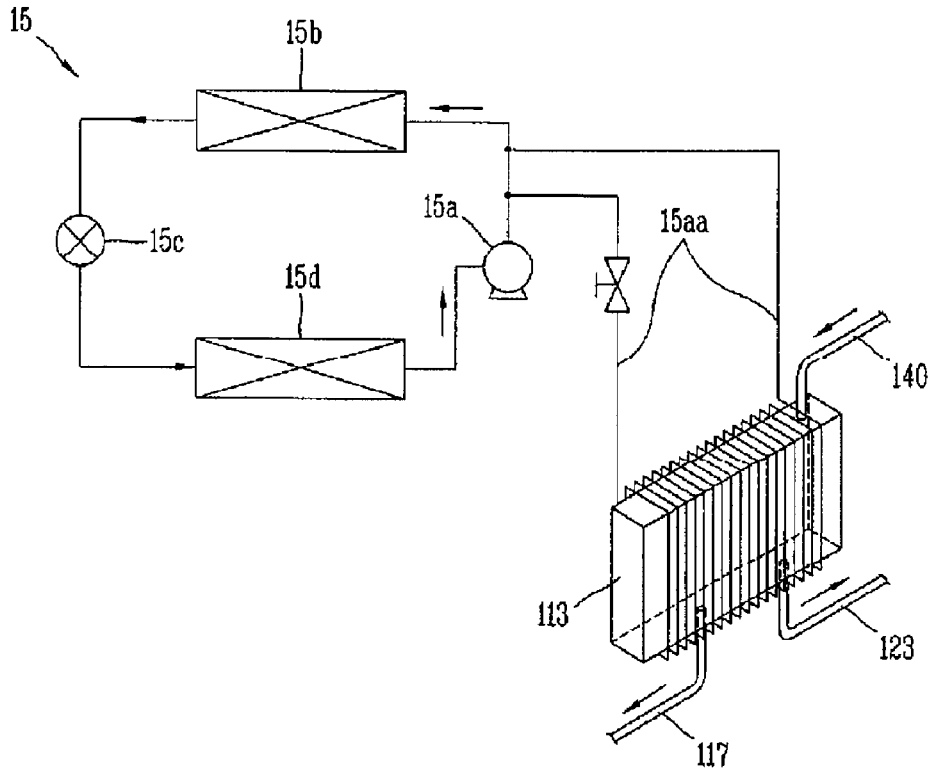
FIG. 6 is an example of a heating portion of FIG. 4.
Figure 7:
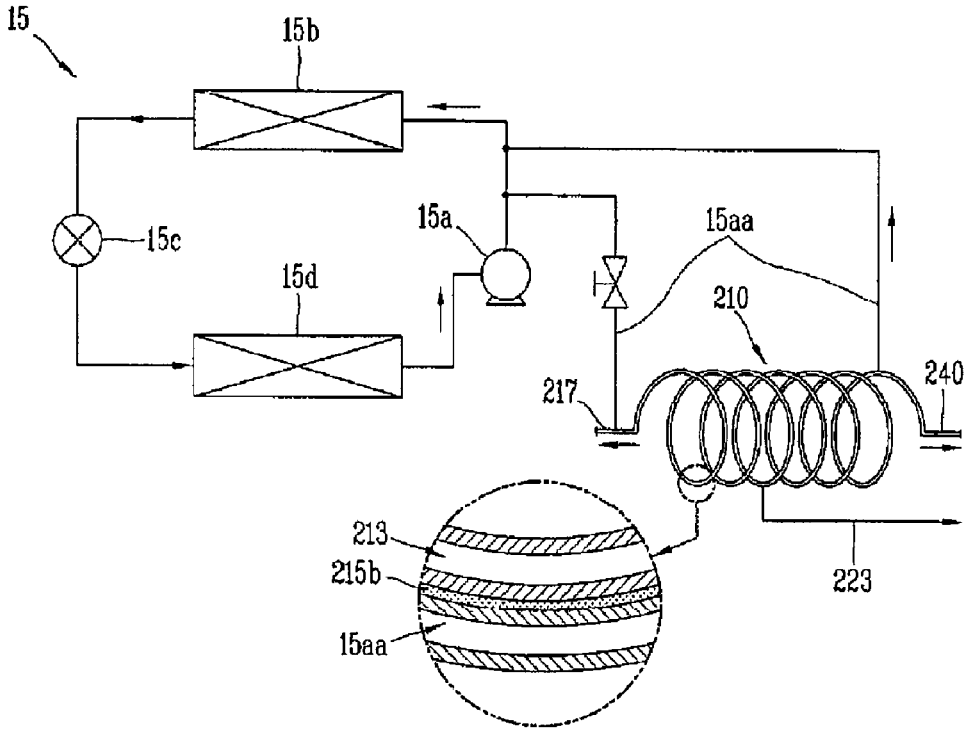
FIG. 7 is an example of the heating portion of FIG. 5.

Referring to FIGS. 6 and 7, the hot water storage portions 113, 213 may be heated by using a high-temperature refrigerant discharged from a compressor 15*a* of a refrigerating cycle 15 that generates cold air to be supplied to the cooling chamber 12. Here, the refrigerating cycle 15 is a closed loop composed of a compressor 15*a*, a condenser 15*b*, an expansion apparatus 15*c*, and an evaporator 15*d*, and serves to cool air around the evaporator 15*d* by making a refrigerant circulate the closed loop. Each of the heating portions 115, 215 is implemented as a heating pipe 15*aa* diverged from one side of a refrigerant pipe through which a high-temperature and high-pressure refrigerant discharged from the compressor 15*a* passes, and converged to another side thereof.

As shown in FIG. 6, the heating pipe 15*aa* may be wound, a plurality of times, on an outer surface of the hot water storage portion 113 implemented as a hermetic container. Differently from this, as shown in FIG. 7, the heating pipe 15*aa* may be curved a plurality of times in the same form as the hot water storage portion 213 implemented as a tube curved a plurality of times. And, the heating pipe 15*aa* may be bonded to the hot water storage portion 213 by a heat transfer material 215*b*.

Figure 8:
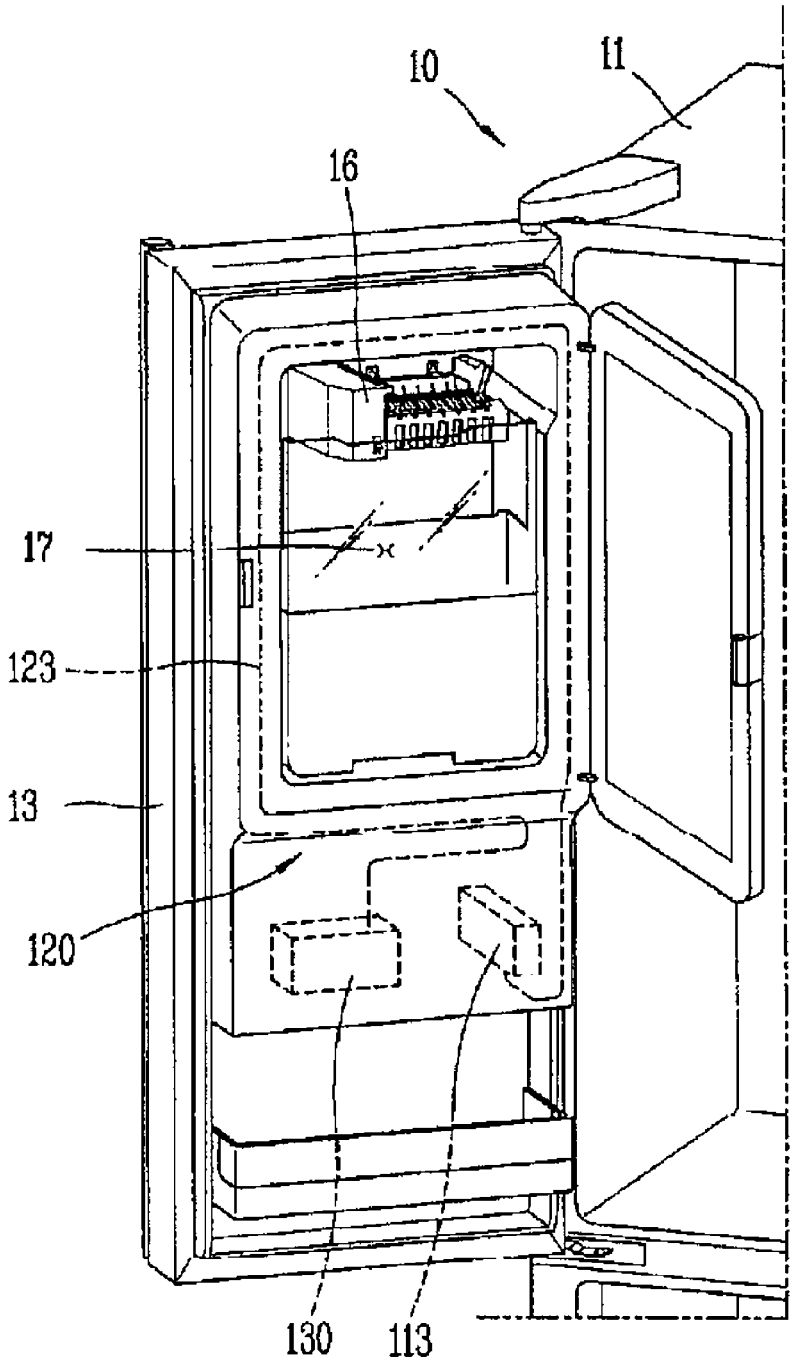
FIG. 8 is a view of a hot water recollection unit of FIG. 1.

Referring to FIG. 8, the hot water recollection unit 120 includes the water recollection pipe 123 for connecting the hot water storage portion 113 of the hot water supply unit 110 and the water source 130 to each other. For example, the water recollection pipe 123 is connected to a bottom surface of the hot water storage portion 113 and an upper portion of the water source 130.

When the hot water storage portion 113 is implemented as shown in FIG. 5, the water recollection pipe 123 may be configured to connected to the end of the hot water storage portion 113. When the water source 130 is implemented as the water storage tank 130*b* of FIG. 3, the water recollection pipe 123 is not necessarily connected to the upper portion of the water source 130.

In addition, the water recollection pipe 123 is curved a plurality of times. The water recollection pipe 123 is positioned on a rear surface of the door 13, and is implemented as a hermetic space partitioned from the refrigerating chamber 12*a*. Also, the water recollection pipe 123 is installed on a wall surface of an ice making chamber 17 having an ice maker 16 installed therein and configured to make ice cubes. Under these configurations, a contact area between the water recollection pipe 123 and cold water of the cooling chamber 12 increases, thereby lowering the temperature of hot water recollected to the water source 130. Although not shown, in order to accelerate heat transfer between the water recollection pipe 123 and the cold water inside the cooling chamber 12, a plurality of heat emitting fins may be disposed on an outer circumferential surface of the water recollection pipe 123.

Figure 9:
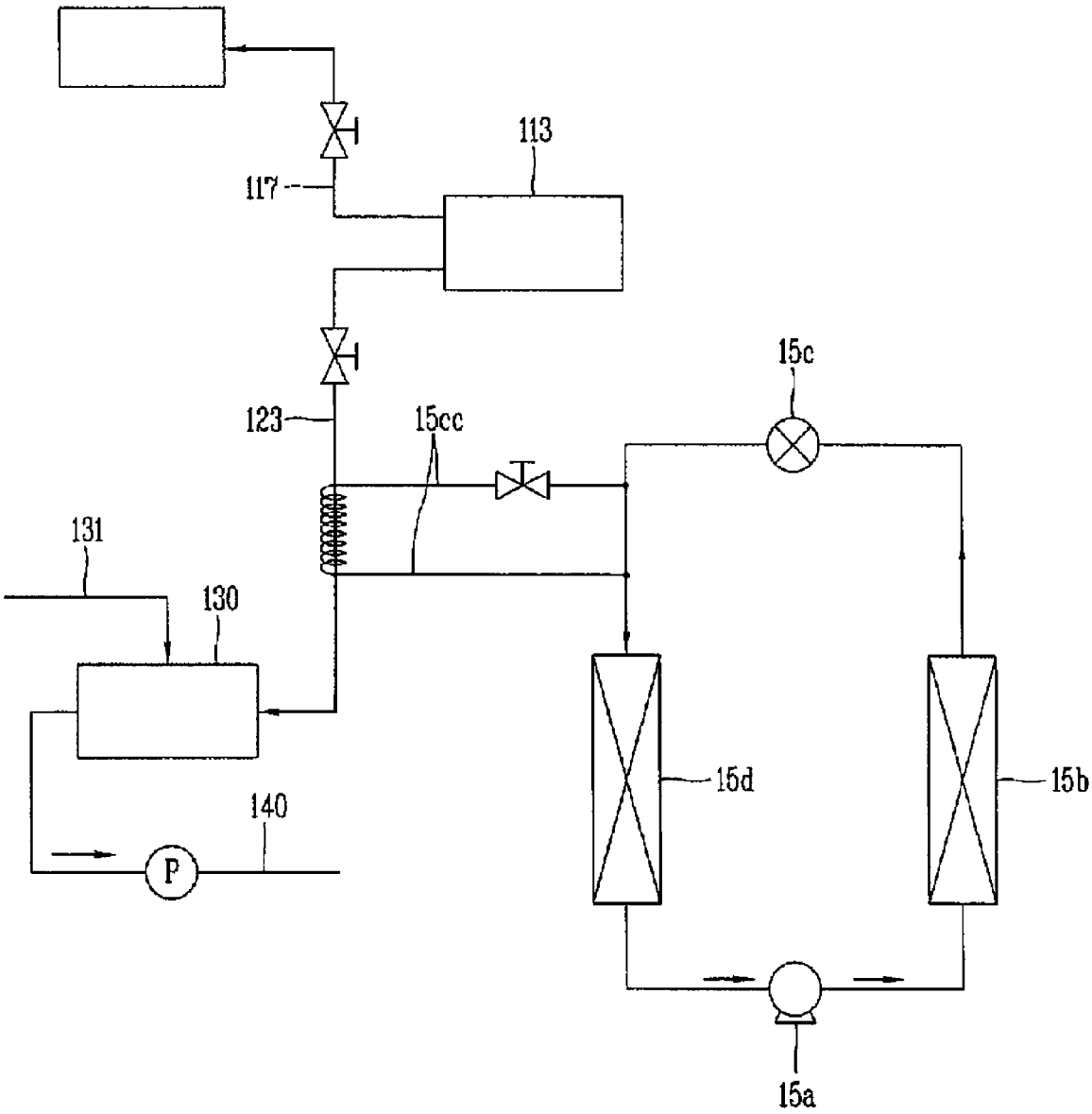
FIG. 9 is an example of the hot water recollection unit of FIG. 8.

Referring to FIG. 9, the water recollection pipe 123 is implemented as a cooling pipe 15*cc* diverged from one side of a refrigerant pipe and converged to another side thereof. Through the refrigerant pipe, a low-temperature and low-pressure refrigerant passes, the refrigerant sucked into the evaporator 15*d* of the refrigerating cycle 15 which generates cold air to be supplied to the cooling chamber 12. For example, the cooling pipe 15*cc* and the water recollection pipe 123 are configured that one can wind another a plurality of times so as to increase a contact area there between. The refrigerator 10 may further include a configuration to generate a hot water dispensing start signal for starting supply of hot water to the hot water storage portion 113, and a hot water dispensing end signal for starting dispensing of the hot water from the hot water storage portion 113.

Figure 10:
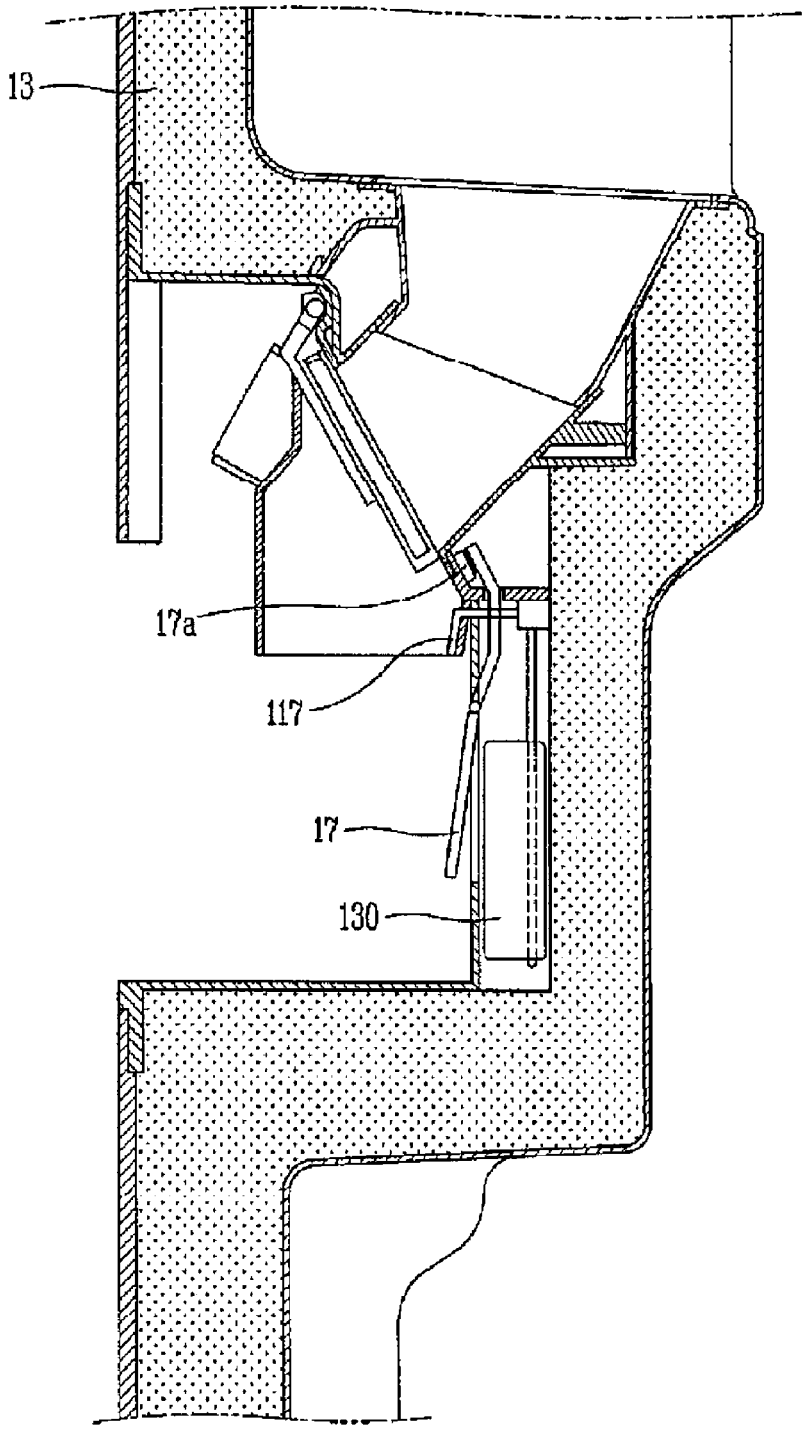
FIG. 10 is a sectional view taken along line 'I-I' in FIG. 1.
Figure 11:
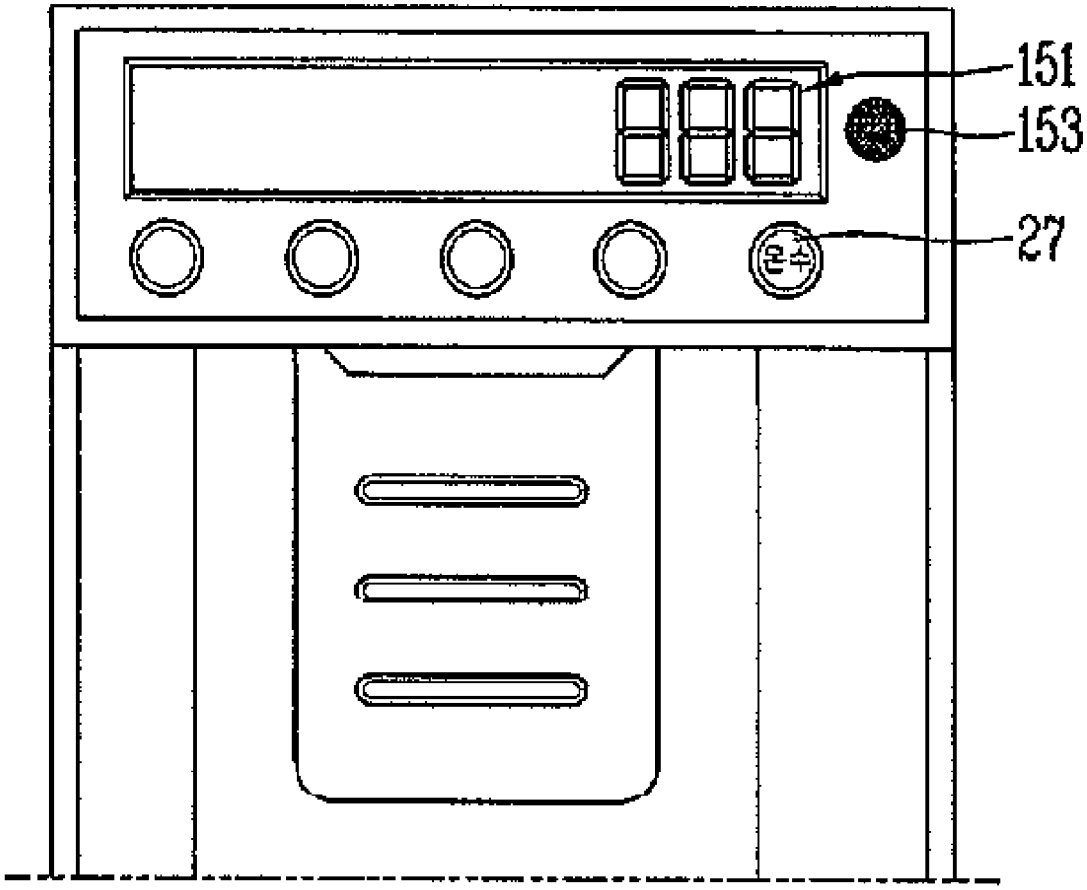
FIG. 11 is a view showing a main part of a front surface of a body of FIG. 1.

Referring to FIG. 10, the hot water dispensing start signal and the hot water dispensing end signal may be generated by a switching member 17*a* disposed at one side of the body 11. The switching member 17*a* is turned on/off by an input from outside of the body 11. For example, when the switching member 17*a* is turned on, the hot water dispensing start signal is generated. On the contrary, when the switching member 17*a* is turned off, the hot water dispensing end signal is generated. As shown in FIG. 10, the to switching member 17*a* may be configured to be turned on/off by using a mechanic button 17 which generates a displacement by an external force applied from outside of the body. As shown in FIG. 11, the switching member 17*a* may be configured as an electronic button 27 turned on/off in a touch or press manner. For instance, an electrostatic induction switch, etc. may be used as the switching member 17*a*. The electronic button 27 may be configured to be automatically turned off when a predetermined time lapses in an 'ON' state, or when a predetermined amount of hot water is discharged out.

The refrigerator 10 having the device for dispensing hot water 100 may further include a display unit 151 for displaying a predicted time or period to indicate when hot water is to be discharged out after the hot water dispensing start signal has been inputted. In the refrigerator 10 having the device for dispensing hot water 100, when the hot water dispensing start signal is inputted water is supplied to the hot water supply unit 110, and then provided hot water in the hot water supply unit 110 to the user. Therefore, the user should wait for a predetermined time (about twenty seconds) after pressing the mechanic button 17 or the electronic button 27.

In this implementation, since the predicted time period is displayed on the display unit 151, the user's boredom or inconvenience due to the waiting may be solved. The predicted time period displayed on the display unit 151 may be configured to gradually decrease by a lapsed time after the hot water dispensing start signal has been generated. This may allow the user to feel that the waiting time is relatively short.

The predicted time period may be displayed on the display unit 151 as to a unit of seconds, and may be configured to decrease by one second. When the predicted time period displayed on the display unit 151 is five seconds, an alarm sound may be generated to outside each second through a sound generator 153 of the body 11.

As mentioned, when hot water having been completely supplied to the hot water supply unit 110, the hot water remaining in the hot water supply unit 110 is recollected to the water source 130 by the hot water recollection unit 120. Furthermore, since the hot water is not stored in the hot water storage portion 113, power consumption required when storing the hot water in the hot water storage portion 113 may be reduced. Because the power source is not needed after the remaining hot water is transferred to the water source.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a body having a cooling chamber;

a door configured to open and close at least a portion of the cooling chamber;

a water source positioned in the body and configured to accommodate water;

a hot water supply unit positioned at the body or the door and configured to receive water from the water source, heat the water, and supply the heated water to outside of the body in response to a hot water dispensing start signal; and a hot water transferring unit that is connected to the hot water supply unit and configured to transfer the water remaining in the hot water supply unit to the water source after supplying the heated water to outside of the body is completed, wherein the water source is a water storage tank configured to store water supplied from outside, and the water storage tank and the hot water supply unit are connected to each other.

2. The refrigerator of claim 1, wherein the hot water supply unit comprises:

a hot water storage portion configured to store water supplied from the water source; and a heating portion configured to heat the water stored in the hot water storage portion.

3. The refrigerator of claim 2, wherein the hot water storage portion is a hermetic container.

4. The refrigerator of claim 2, wherein the heating portion is a heat wire configured to generate heat by an electric resistance.

5. The refrigerator of claim 1, wherein the water storage tank is installed inside the cooling chamber or at a rear surface of the door.

6. The refrigerator of claim 1, wherein the hot water transferring unit includes a water pipe connected to the water source and configured to transfer the water remaining in the hot water supply unit to the water source.

7. The refrigerator of claim 6, wherein the water pipe has a plurality of heat emitting fins on an outer circumferential surface.

8. The refrigerator of claim 1, wherein the water remaining in the hot water supply unit is transferred in response to detecting a hot water dispensing end signal that indicates supplying the heated water to outside of the body is completed.

9. The refrigerator of claim 1, wherein the hot water transferring unit is connected to the water source and configured to transfer the water remaining in the hot water supply unit to the water source for recollection.

10. The refrigerator of claim 1, wherein an amount of the water supplied to the hot water supply unit is adjusted by controlling an operation time.

11. The refrigerator of claim 1, further comprising a switching unit configured to generate the hot water dispensing start signal.

12. The refrigerator of claim 11, wherein the switching unit is configured to be turned on/off by using an electronic button.

13. The refrigerator of claim 1, further comprises a display unit configured to display a predicted time or period when hot water is supplied to a user.

14. The refrigerator of claim 13, wherein an alarm sound is generated during displaying the predicted time or period.

15. A refrigerator comprising:

a body having a cooling chamber;

a door configured to open and close at least a portion of the cooling chamber;

a water source positioned outside of the body configured to accommodate water; and a hot water supply dispenser comprising:

a hot water supply unit positioned at the body or the door and configured to heat water supplied from the water source and supply the heated water to outside of the body in response to a hot water dispensing start signal; and a hot water transferring unit connected to the hot water supply unit and configured to transfer the water remaining in the hot water supply unit to the water source after supplying the heated water to outside of the body is completed, wherein the water source is a water tank configured to store water at a room temperature, and the water tank and the hot water supply unit are connected to each other.

16. The refrigerator of claim 15, further comprising a display unit configured to display a predicted time or period when hot water is supplied to a user.

17. A refrigerator comprising:

a body having a cooling chamber;

a door configured to open and close at least a portion of the cooling chamber;

a water source positioned within the body and configured to accommodate water; and a hot water supply dispenser comprising:

a hot water storage portion configured to store water supplied from the water source; and a heating portion configured to heat the water stored in the hot water storage portion, wherein the water source is a water storage tank configured to store water supplied from outside, and the water storage tank and the hot water supply unit are connected to each other, and wherein the water stored in the hot water storage portion is heated by the heating portion for a predetermined time or period, the heated water in the hot water storage portion is supplied to outside of the body and the remaining hot water in the hot water storage portion is transferred to the water source after supplying the heated water to outside of the body is completed.

18. The refrigerator of claim 17, wherein the water remaining in the hot water storage portion is disposed from the water storage portion in response to detecting a hot water dispensing end signal.

19. The refrigerator of claim 17, further comprises a display unit configured to display a predicted time or period when hot water is supplied to a user.

* * * * *